United States Patent [19]

Peregudov et al.

[11] 4,131,456

[45] Dec. 26, 1978

[54] CHILL-FREE FOUNDRY IRON

[76] Inventors: Lev V. Peregudov, ulitsa Puzakova 39, Kv. 231; Mikhail M. Malashin, ulitsa Liteizina, 74, kv. 30, both of Tula, U.S.S.R.

[21] Appl. No.: 859,759

[22] Filed: Dec. 12, 1977

[51] Int. Cl.[2] ..... C22C 37/00

[52] U.S. Cl. ..... 75/124; 75/123 CB; 75/123 E

[58] Field of Search ..... 75/124, 123 CB, 123 E; 148/35

[56] References Cited

U.S. PATENT DOCUMENTS

| | | | |
|---|---|---|---|
| 3,997,338 | 12/1976 | van Eeghem et al. | 75/123 CB |
| 4,032,622 | 6/1977 | von Plessen et al. | 75/123 CB |

FOREIGN PATENT DOCUMENTS

| | | | |
|---|---|---|---|
| 47-18337 | 5/1972 | Japan | 75/123 CB |
| 361217 | 9/1969 | U.S.S.R. | 75/123 CB |
| 434126 | 12/1974 | U.S.S.R. | 75/125 |
| 449103 | 4/1975 | U.S.S.R. | 75/123 CB |
| 475409 | 9/1975 | U.S.S.R. | 75/124 |
| 492586 | 12/1975 | U.S.S.R. | 75/124 |

*Primary Examiner*—Arthur J. Steiner
*Attorney, Agent, or Firm*—Fleit & Jacobson

[57] ABSTRACT

The invention provides a chill-free foundry iron consisting essentially of, in per cent by weight:

| | |
|---|---|
| carbon | from 2.8 to 4.0 |
| silicon | from 1.5 to 2.6 |
| manganese | from 0.2 to 1.2 |
| cerium | from 0.01 to 0.05 |
| aluminium | from 0.06 to 0.6 |
| calcium | from 0.04 to 0.1 |
| sulfur | up to 0.20 |
| phosphorus | up to 0.30 and |
| iron | the balance |

3 Claims, No Drawings

CHILL-FREE FOUNDRY IRON

BACKGROUND OF THE INVENTION

1. Field of the Invention

The invention relates to chill-free foundry irons usable in foundry production.

2. Description of the Prior Art

USSR Inventor's Certificate No. 380,736 discloses a foundry iron consisting essentially of, in per cent by weight:

| | |
|---|---|
| carbon | from 3.5 to 4.3 |
| silicon | from 1.0 to 2.9 |
| manganese | from 0.05 to 0.8 |
| aluminium | from 0.03 to 0.2 |
| calcium | from 0.005 to 0.08 |
| magnesium | from 0.01 to 0.1 |
| sulfur | up to 0.01 |
| phosphorus | up to 0.01 |
| iron | the balance |

However, castings of this foundry iron have a chilled surface layer of low mechanical properties and are difficult to machine.

Due to the chilled surface, castings of said foundry iron have to be annealed in heat treatment furnaces with the aim of improving the mechanical properties of the surface layer of the castings and the machinability thereof.

Annealing of iron castings improves the mechanical properties of the surface layer and the machinability of the castings, but impairs other properties of the basic metal and substantially raises the cost of the castings.

Attempts have been made to provide a foundry iron that would be free of chill on the surface. Such a foundry iron is disclosed in USSR Inventor's Certificate No. 377,394, the chemical composition of the foundry iron being, in per cent by weight:

| | |
|---|---|
| carbon | from 2.8 to 4.0 |
| silicon | from 0.3 to 0.9 |
| manganese | from 0.2 to 1.2 |
| lanthanum | from 0.0002 to 0.1 |
| cerium | from 0.0005 to 0.1 |
| neodymium | from 0.0001 to 0.1 |
| praseodymium | from 0.00005 to 0.1 |
| one of the elements: samarium, gadolinium, terbium, europium, dysprosium, holmium, erbium, thulium, ytterbium, lutecium | from 0.00015 to 0.1 |
| sulfur | up to 0.15 |
| phosphorus | up to 0.30 |
| iron | the balance |

This foundry iron is suitable for the production of castings free of surface chill, 4 mm thick and over, said iron, however, being costly as it contains rare-earth metals.

In addition, said foundry iron cannot be used to manufacture castings of complicated configurations and sections less than 4 mm thick, or castings poured in metal, or other types of rapid-cooling moulds.

Due to an increase in the output of parts cast into metal moulds and to a need for minimizing the consumption of metal in foundry production, there is an urgent need for devising a means to produce castings of chill-free surface. The unavailability of such a foundry iron results in considerable difficulties in machining of castings and raises the cost of their manufacture.

SUMMARY OF THE INVENTION

It is an object of the invention to provide a foundry iron less prone to chilling (e.g., a foundry iron free from chilled surface).

Another no less important object of the invention is to minimize the cost of foundry iron melting.

Still another object of the invention is to improve the machinability of castings from said foundry iron.

The above and other objects are attained by the provision of a chill-free foundry iron containing carbon, silicon, manganese, aluminium, calcium, phosphorus, sulfur and iron, said chill-free foundry iron, according to the invention, additionally including cerium, the percentage of the aforesaid components being as follows, in per cent by weight:

| | |
|---|---|
| carbon | from 2.8 to 4.0 |
| silicon | from 1.5 to 2.6 |
| manganese | from 0.2 to 1.2 |
| aluminium | from 0.06 to 0.6 |
| calcium | from 0.04 to 0.1 |
| sulfur | up to 0.20 |
| cerium | from 0.01 to 0.05 |
| phosphorus | up to 0.30 and |
| iron | the balance |

These components and their relative percentages make up a foundry iron, the castings thereof being free from surface chill. In addition, the components of said foundry iron are relatively cheap and readily available.

A foundry iron becomes more and more prone to chilling as its silicon content drops. On the other hand, an increase in silicon content adversely affects the mechanical properties of the foundry iron. When the percentages of aluminium and calcium are less than those specified above according to the invention, the foundry iron is susceptible of a substantial chilling. By contrast, an increase in aluminium and calcium contents impairs the quality of the foundry iron. A lesser cerium content than that specified above lowers the graphitizing capacity, whereas an excess of cerium contributes to greater chilling of the foundry iron.

A percentage of manganese less than that specified above has an adverse effect on the mechanical properties of castings. Should the content of manganese exceed the proposed value, the castings become susceptible to a greater chilling.

Excess of phosphorus and sulfur over the amounts specified above impairs the quality of the foundry iron.

DETAILED DESCRIPTION

The following Examples I, II, and III, describing chill-free foundry iron having the compositions set forth in Table 1, hereafter, are illustrative of the invention.

Table 1

| Reference of foundry iron | Chemical composition, per cent | | | | | | | | | |
|---|---|---|---|---|---|---|---|---|---|---|
| | carbon | silicon | manganese | cerium | aluminium | sulfur | calcium | phosphorus | iron | Total |
| Example I | 2.8 | 1.5 | 0.2 | 0.01 | 0.06 | 0.1 | 0.04 | 0.1 | 95.19 | 100 |
| Example II | 3.4 | 2.0 | 0.7 | 0.02 | 0.15 | 0.15 | 0.07 | 0.02 | 93.30 | 100 |
| Example III | 4.0 | 2.6 | 1.2 | 0.05 | 0.6 | 0.20 | 0.1 | 0.3 | 90.95 | 100 |

Tests were carried out by comparison of the above foundry irons represented by Examples I, II, and III with a known foundry iron for chill-free castings consisting essentially of, in per cent by weight:

| | |
|---|---|
| carbon | 3.5 |
| silicon | 0.6 |
| manganese | 0.7 |
| lanthanum | 0.001 |
| cerium | 0.01 |
| neodymium | 0.001 |
| praseodymium | 0.00001 |
| lutecium | 0.0002 |
| sulfur | 0.05 |
| phosphorus | 0.2 and |
| iron | the balance. |

The susceptibility to chilling was evaluated in terms of the maximum thickness of the chilled layer of a process wedge-shaped sample moulded in a green sand-clay mould.

The results of the tests are listed in the following Table 2.

Table 2

| Reference of foundry iron | Known in the prior art | Foundry Iron of Example I | Foundry Iron of Example II | Foundry Iron of Example III |
|---|---|---|---|---|
| Thickness of the chilled portion of the wedge (mm) | 4.2 | 1.1 | 0.0 | 1.8 |

The tests evidence the fact that the invention substantially minimizes the susceptibility of chilling of the foundry iron and so eliminates the need for annealing and improves the machinability of castings.

A lesser susceptibility to chilling has been obtained by introducing graphitizing elements, and also a lesser cost by a rational substitution of costly alloying elements by cheaper ones.

Castings of complicated configuration with sections less than 4 mm thick poured with the foundry iron according to the invention were free of surface chilling.

What is claimed is:

1. A chill-free foundry iron consisting essentially of, in per cent by weight:

| | |
|---|---|
| carbon | from 2.8 to 4.0 |
| silicon | from 1.5 to 2.6 |
| manganese | from 0.2 to 1.2 |
| cerium | from 0.01 to 0.05 |
| aluminium | from 0.06 to 0.6 |
| calcium | from 0.04 to 0.10 |
| sulfur | up to 0.20 |
| phosphorus | up to 0.30 |
| and iron | the balance |

2. Chill-free foundry iron in a casting having a thickness of less than 4 mm.

3. A casting of claim 2 wherein the thickness of the chilled surface layer ranges from 0.0 to 1.8 mm.

* * * * *